US012691348B1

(12) United States Patent
McGill, Jr.

(10) Patent No.: US 12,691,348 B1
(45) Date of Patent: Jul. 28, 2026

(54) BASKETBALL BACKBOARD SHOT ASSISTANCE APPARATUS

(71) Applicant: Kenneth McGill, Jr., Lincoln, NE (US)

(72) Inventor: Kenneth McGill, Jr., Lincoln, NE (US)

( * ) Notice: Subject to any disclaimer, the term of this patent is extended or adjusted under 35 U.S.C. 154(b) by 643 days.

(21) Appl. No.: 18/109,828

(22) Filed: Feb. 14, 2023

(51) Int. Cl.
*A63B 69/00* (2006.01)
*A63B 63/08* (2006.01)
*A63B 71/06* (2006.01)

(52) U.S. Cl.
CPC ..... *A63B 69/0071* (2013.01); *A63B 63/083* (2013.01); *A63B 2071/0694* (2013.01)

(58) Field of Classification Search
CPC ..... A63B 69/0071; A63B 63/083; A63B 2071/0694
USPC ..... 473/447
See application file for complete search history.

(56) References Cited

U.S. PATENT DOCUMENTS 5,695,415 A 12/1997 Docherty et al.
6,758,768 B2 7/2004 Spencer
6,843,738 B2 1/2005 Spencer
7,056,242 B2 6/2006 Tsinberg
7,713,149 B2 5/2010 Docherty
7,955,082 B1 * 6/2011 Gause ..... G09B 19/0038 473/422
8,986,140 B1 3/2015 Fuller
11,117,032 B2 9/2021 Falbo
2022/0032151 A1 * 2/2022 Wilson ..... A63B 71/0622 473/456

* cited by examiner

*Primary Examiner* — Mitra Aryanpour
(74) *Attorney, Agent, or Firm* — Cramer Patent & Design, PLLC.; Aaron R. Cramer

(57) ABSTRACT

A basketball backboard shot assistance apparatus has a vertical alignment element that is configured for attachment with the rear of a basketball backboard. The apparatus includes a downward first trajectory target line, a level trajectory target area, and an upward second trajectory target line that are disposed on the backboard. The vertical alignment element is spaced a predetermined distance from the backboard and can be attached to the backboard using various methods such as a bracket mount, pole mount, ground stand mount or backboard mount. The first trajectory line may be utilized to train for longer shots. A portion of the vertical alignment element extends past the top edge of the backboard, thus providing a guide for players approaching the backboard to use as a target when attempting shots. The intersection of the vertical alignment element and the level trajectory target area is used as a target for the ball when a shot is attempted. The upward second trajectory target line is used for short shots and layups, and the level trajectory target area is used for mid-range shots.

2 Claims, 7 Drawing Sheets

BASKETBALL BACKBOARD SHOT ASSISTANCE APPARATUS

RELATED APPLICATIONS

Non-applicable.

FIELD OF THE INVENTION

The present invention relates to a basketball training device and more specifically to a basketball backboard shot assistance apparatus.

BACKGROUND OF THE INVENTION

Basketball is a sport that requires a combination of skill, agility, and precision. A crucial part of the game is the ability to make accurate shots, which can be challenging for many players, especially for beginners. One of the most significant factors that affect the accuracy of a shot is the player's aim.

In traditional basketball courts, players rely on their own visual judgment to align their shots with the hoop. However, this method can be unreliable, especially for players who are still learning the sport. In some cases, players may not have enough experience or understanding of the game to make accurate shots consistently.

In an effort to improve the accuracy of shots, various basketball training aids have been developed over the years. Some of these aids include aiming devices that attach to the backboard or the hoop, trajectory lines on the court, and devices that project target lines onto the court. While these aids may provide some assistance, they may not be suitable for all players or suitable for all types of shots. The present invention is a basketball backboard shot assistance apparatus that aims to address the limitations of traditional training aids by providing a more versatile and user-friendly solution.

SUMMARY OF THE INVENTION

To achieve the above and other objectives, the present invention provides for a basketball backboard shot assistance apparatus which has a vertical alignment element that can be attached to the backboard's rear using various methods like bracket, pole, ground stand, or backboard mount. The apparatus also includes a downward first trajectory target line, a level trajectory target area, and an upward second trajectory target line. These lines are designed to assist player's shot, the vertical alignment element extends past the top edge of the backboard, that helps the player to use it as a guide. The player can use the intersection of the vertical alignment element and the level trajectory target area as a target for the ball when attempting a shot. Upward second trajectory target line is for short shots and layups and level trajectory target area for mid-range shots. Additionally, the first trajectory target line for longer shots. The arrows in the trajectory target lines can be an integral part of the backboard or removable applique which can assist the player. This invention is suitable for use with a floor of a basketball court and a backboard with hoop attached to it.

BRIEF DESCRIPTION OF THE DRAWINGS

These and other features, aspects, and advantages of the present disclosure will become better understood with regard to the following description, appended claims, and accompanying drawings where:

DESCRIPTIVE KEY

Figure 1:
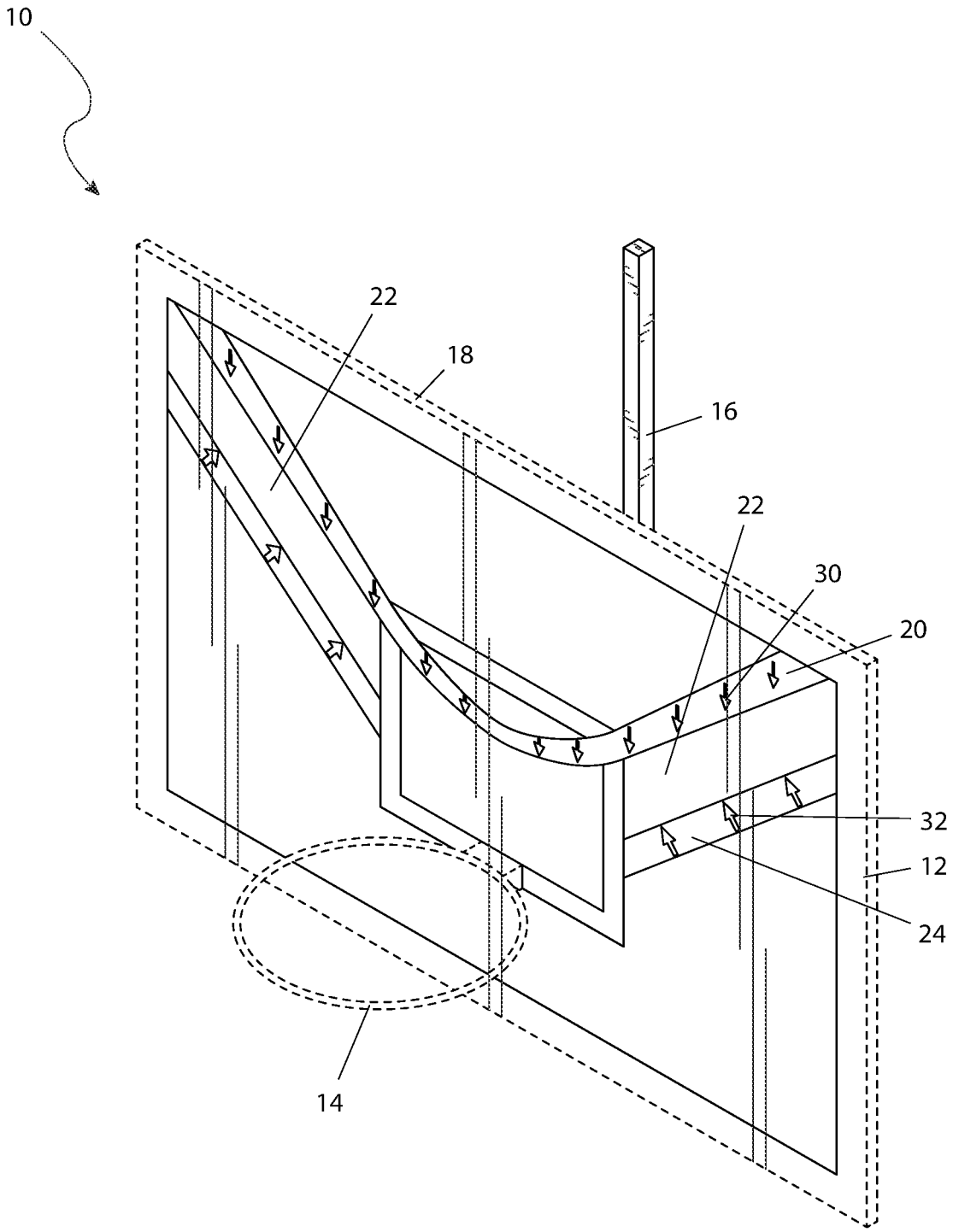
FIG. 1 is perspective view of a basketball backboard shot assistance apparatus, according to an embodiment of this disclosure.

10 basketball backboard shot assistance apparatus
12 backboard
14 hoop
16 element
18 top edge
20 first trajectory target line
22 level trajectory target area
24 second trajectory target line
30 first arrows
32 second arrows
A position A
B position B
C position C
F basketball court
I intersection

DETAILED DESCRIPTION

The following disclosure is provided to describe various embodiments of a basketball backboard shot assistance apparatus 10 used to assist with a player making a basketball shot while properly using a backboard 12, according to an embodiment of this disclosure.

Skilled artisans will appreciate additional embodiments and uses of the present invention that extend beyond the examples of this disclosure. Terms included by any claim that may be presented in any yet-to-be-filed non-provisional patent application are to be interpreted as defined within this disclosure. Singular forms should be read to contemplate and disclose plural alternatives. Similarly, plural forms should be read to contemplate and disclose singular alternatives. Conjunctions should be read as inclusive except where stated otherwise.

Expressions such as "at least one of A, B, and C" should be read to permit any of A, B, or C singularly or in combination with the remaining elements. Additionally, such groups may include multiple instances of one or more element in that group, which may be included with other elements of the group. All numbers, measurements, and values are given as approximations unless expressly stated otherwise.

Various aspects of the present disclosure will now be described in detail, without limitation. Skilled readers should not view the inclusion of any alternative labels as limiting in any way.

At games fans and coaches say, "use the backboard" to players. Some players do not use the backboard 12 because they do not know where to aim and miss shots when trying to bank the shot. Basketball bank shots are a high percentage shot if done correctly. Given the correct training, shooters will utilize the backboard 12 more frequently to score more points. Referring now to FIGS. 1-9, an illustrative basketball backboard shot assistance apparatus herein described as the "apparatus" 10 will now be discussed in more detail.

Figure 2:
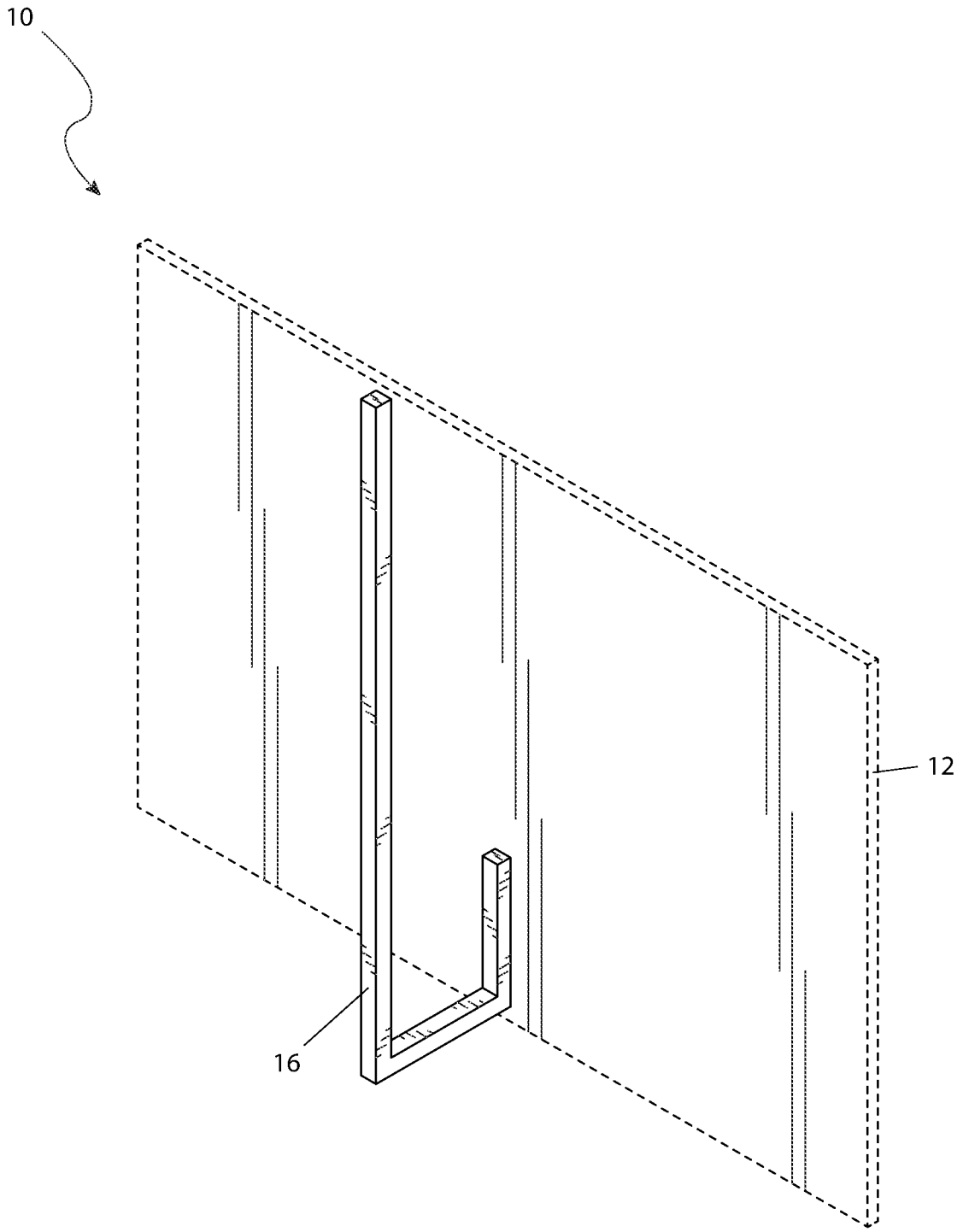
FIG. 2 is a back perspective view of a basketball backboard shot assistance apparatus, according to an embodiment of this disclosure.
Figure 3:
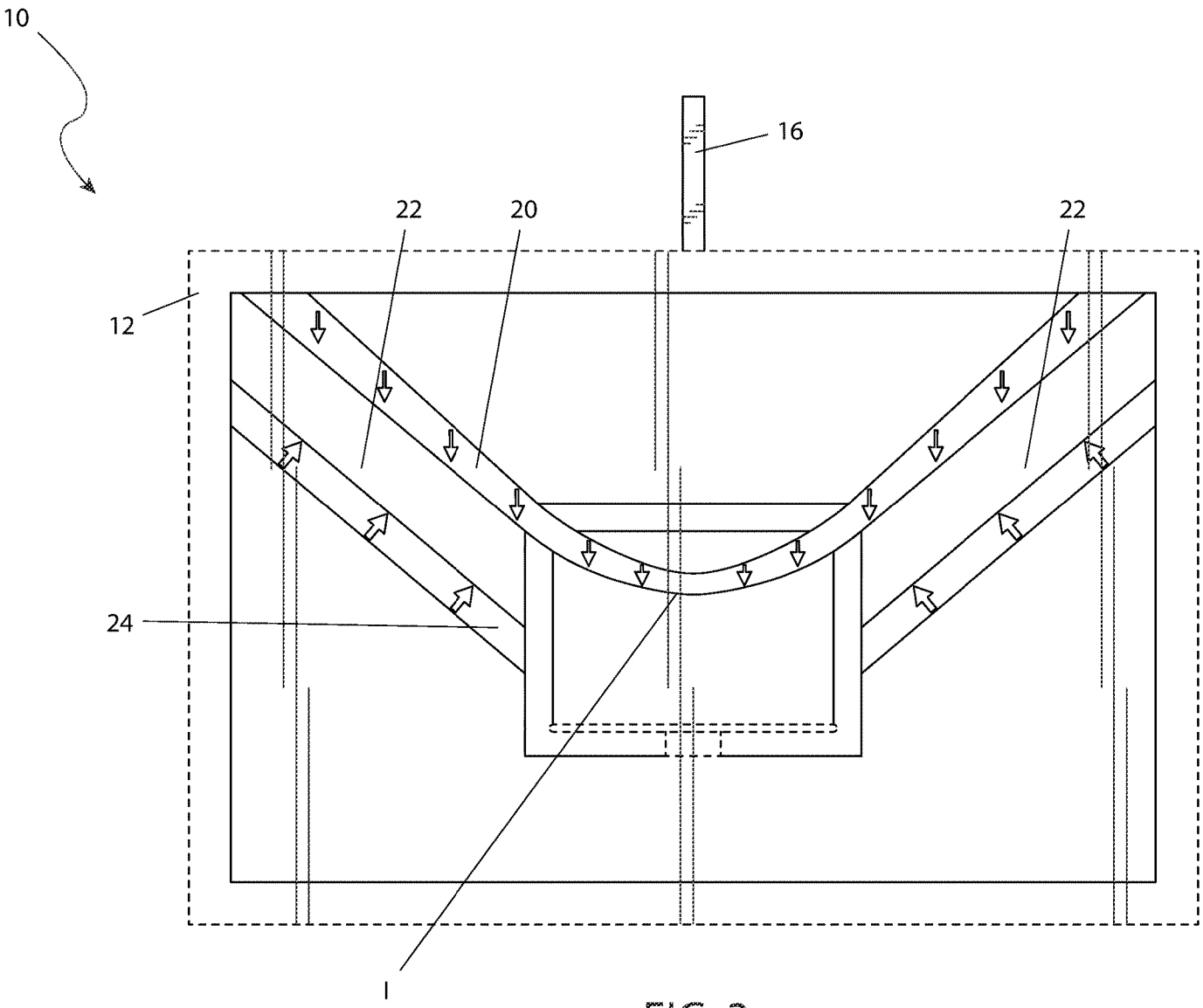
FIG. 3 is a front view of a basketball backboard shot assistance apparatus, according to an embodiment of this disclosure.
Figure 4:
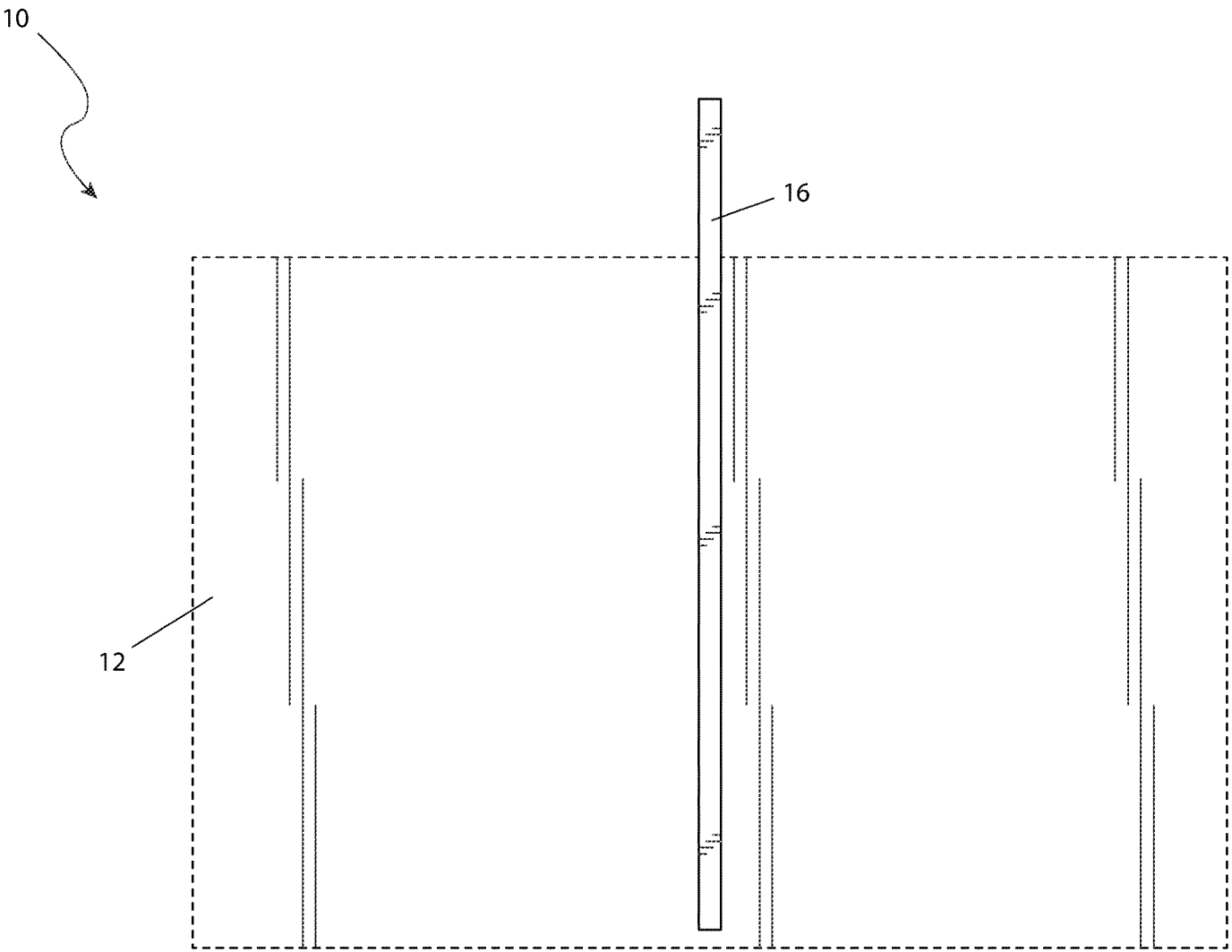
FIG. 4 is a back view of a basketball backboard shot assistance apparatus, according to an embodiment of this disclosure.
Figure 6:
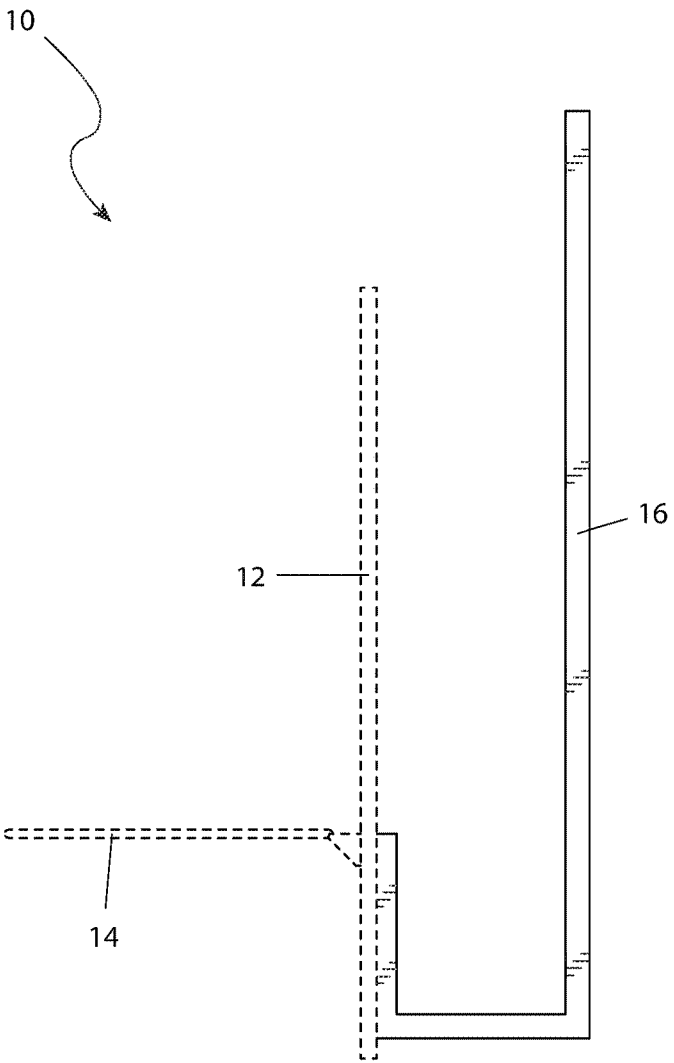
FIG. 6 is an opposite side view of a basketball backboard shot assistance apparatus, according to an embodiment of this disclosure.
Figure 5:
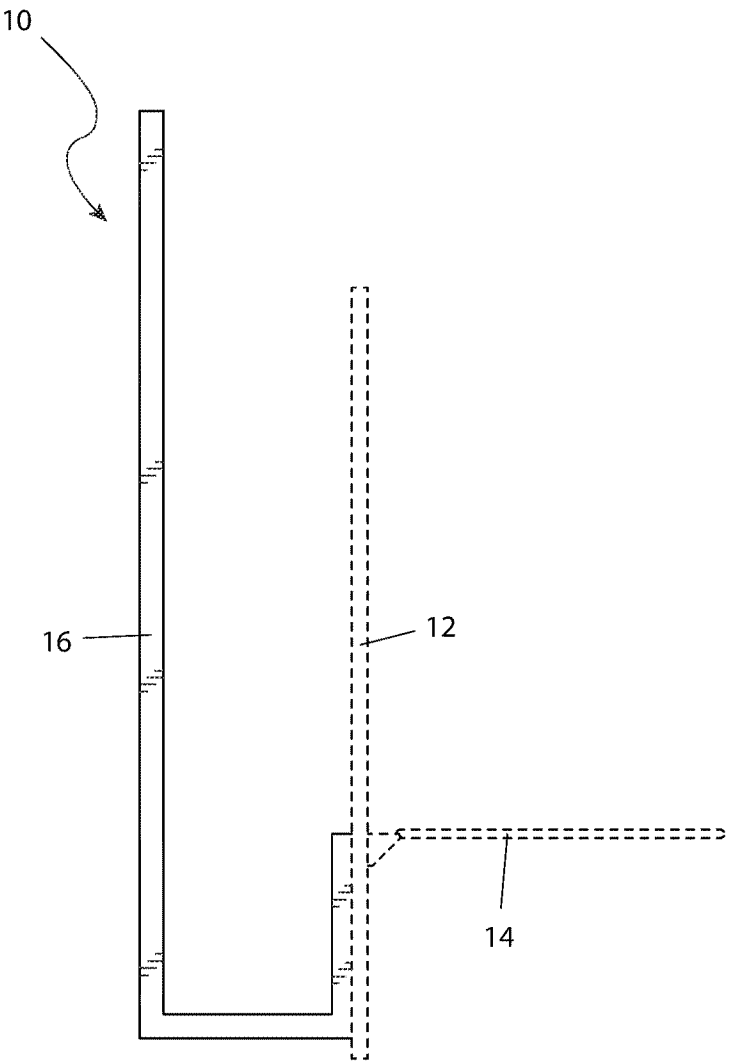
FIG. 5 is a side view of a basketball backboard shot assistance apparatus, according to an embodiment of this disclosure.
Figure 7:
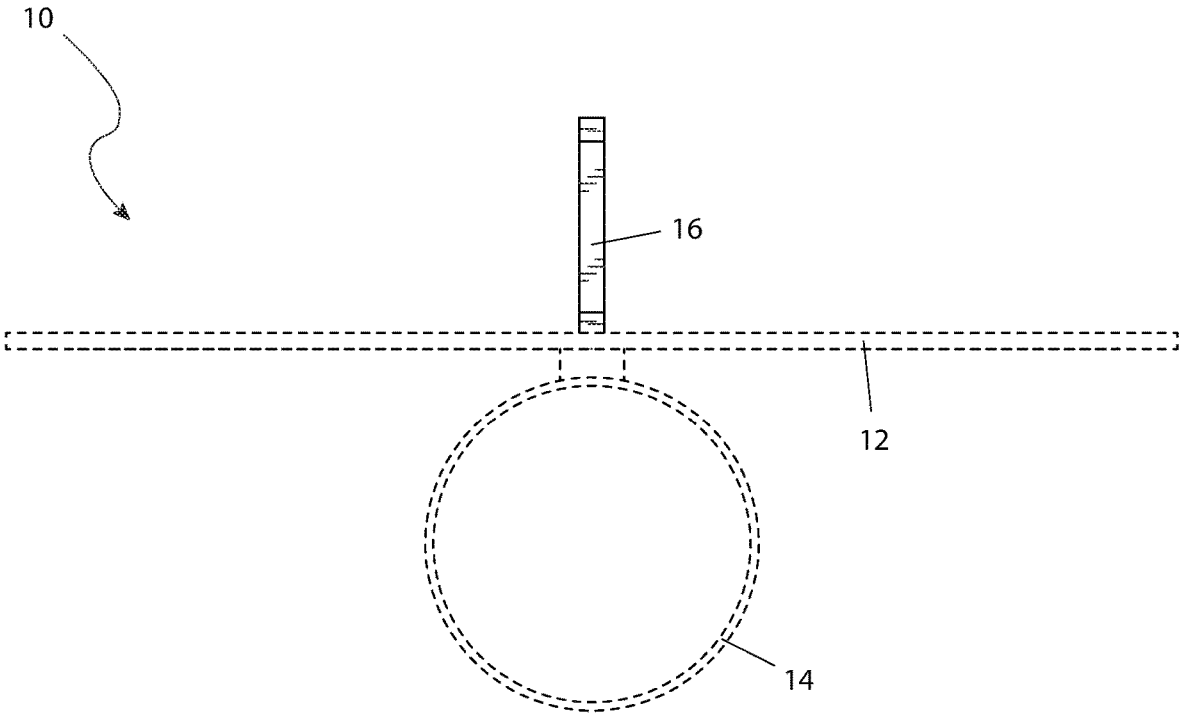
FIG. 7 is a top view of a part of a basketball backboard shot assistance apparatus, according to an embodiment of this disclosure.
Figure 8:
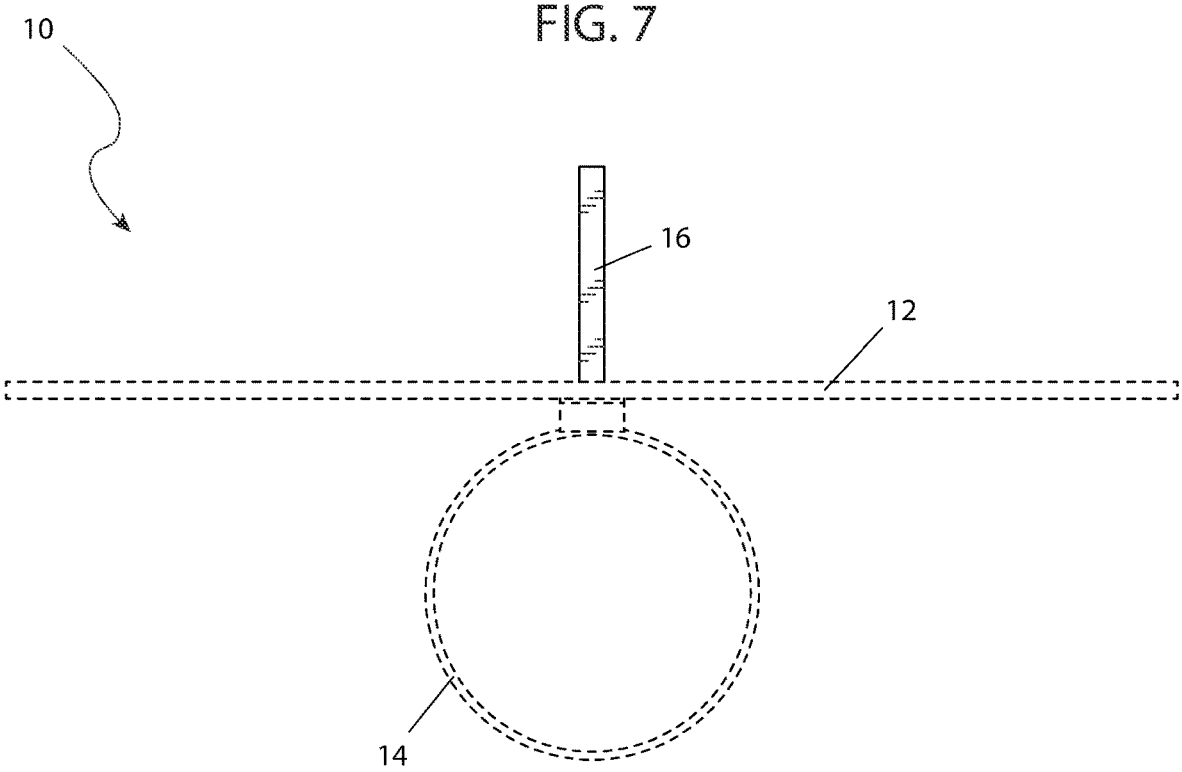
FIG. 8 is a bottom view of a part of a basketball backboard shot assistance apparatus, according to an embodiment of this disclosure.

The apparatus 10 is configured for use with a floor of a basketball court F and a backboard 12 having a hoop 14 attached thereto, as shown in FIG. 1. The apparatus 10 includes a vertical alignment element 16. The element 16 is configured for attachment with a rear of a backboard 12, as shown in FIGS. 2, 5 and 6. FIG. 3 shows the element 16 attached and positioned behind the backboard 12 such that a portion of the element 16 extends past a top edge 18 of the backboard 12 such that a player approaching the backboard 12 can use the element 16 as a guide for a shot. FIGS. 7 and 8 show a top view of the apparatus 10 attached to the backboard 12. In some embodiments, the element 16 may be spaced a predetermined distance from the backboard 12 or may be positioned flush against the backboard 12.

The apparatus 10 includes a downward first trajectory target line 20, a level trajectory target area 22 and an upward second trajectory target line 24. As shown in FIG. 3, a player can use an intersection I of the element 16 and one (1) of the trajectory target lines or area 20, 22, 24 as a target for the ball when a shot is attempted. The player uses the second trajectory target line 24 for short shots and layups, the level trajectory target area 22 for mid-range shots and the first trajectory target line 20 for longer shots. In some embodiments, the first trajectory target line 20 includes downward-facing first arrows 30 to assist the player. In some embodiments, the second trajectory target line 24 includes upward-facing second arrows 32 to assist the player. The trajectory target lines or area 20, 22, 24 may be an integral part of the backboard 12 or an applique removably attached thereto. Similarly, the first and second arrows 30, 32, may be an integral portion of the relative trajectory target lines or area 20, 22, 24 or a removable applique attachable thereto.

Figure 9:
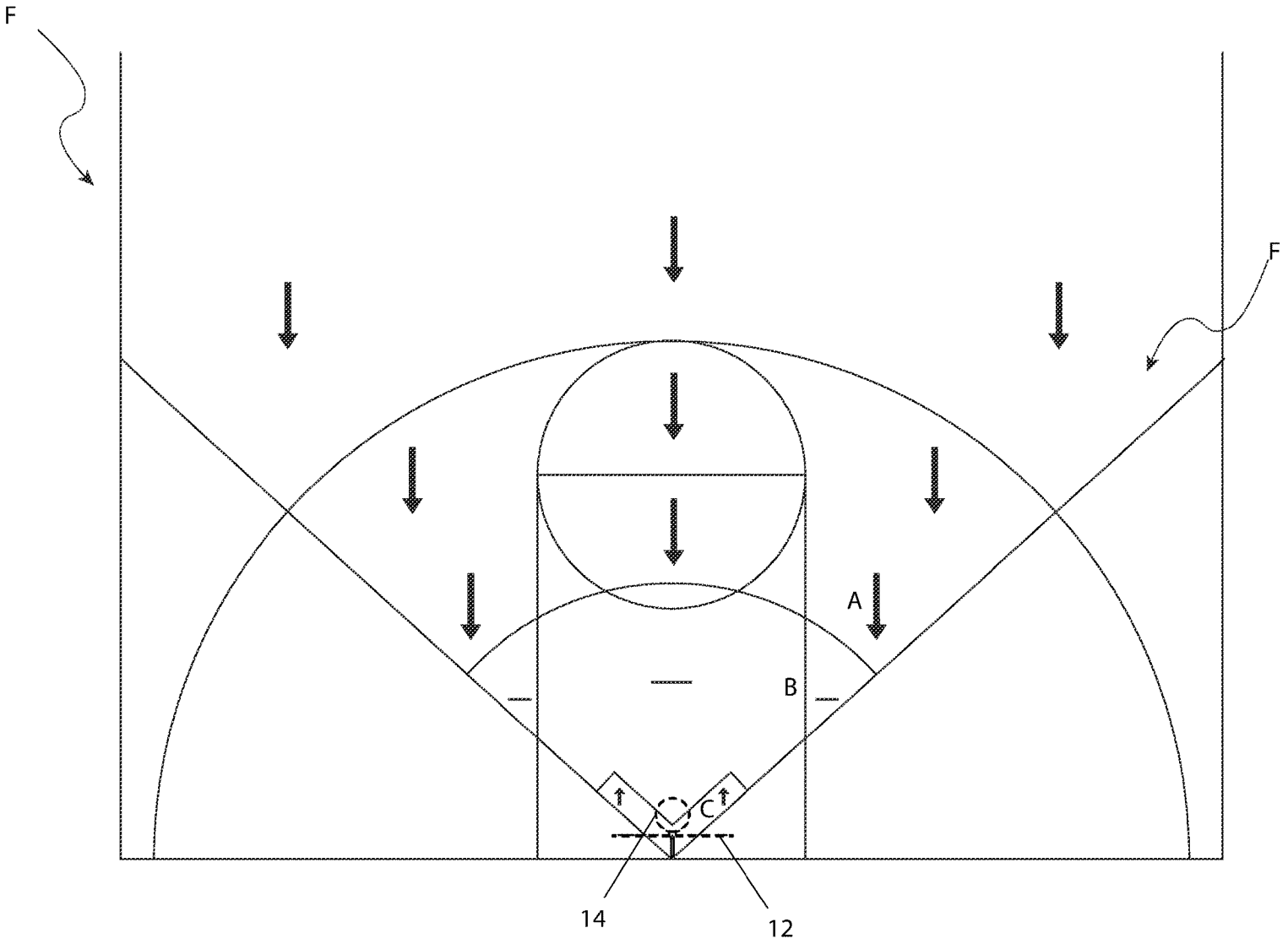
FIG. 9 shows a basketball backboard shot assistance apparatus used on a basketball court, according to an embodiment of this disclosure.

In use, as shown in FIG. 9, a basketball court F includes a backboard 12 having a hoop 14. The element 16 is attached with the backboard 12 using for example, a bracket mount, a pole mount, a ground stand, or a backboard mount. The trajectory target lines or area 20, 22, 24 are set up on backboard 12, if necessary. A player decides what length of shot to take for example, a long or mid-range shot from position A, a short shot from position B or a layup from position C. The player lines up intersection I of element 16 with the chosen specific trajectory target lines or area 20, 22, 24 that is deemed necessary to complete a successful shot attempt. The player takes the shot to attempt to hit the area on the backboard 12 for a successful bank shot.

While various aspects of the present invention have been described in the above disclosure, the description of this disclosure is intended to illustrate and not limit the scope of the invention. The invention is defined by the scope of the claims of a corresponding nonprovisional utility patent application and not the illustrations and examples provided in the above disclosure. Skilled artisans will appreciate additional aspects of the invention, which may be realized in alternative embodiments, after having the benefit of the above disclosure. Other aspects, advantages, embodiments, and modifications are within the scope of the claims of a corresponding nonprovisional utility patent application.

What is claimed is:

1. A basketball backboard shot assistance apparatus, comprising:

a backboard having a front impact surface and an opposing rear surface;

a vertical alignment element rigidly affixed to the rear surface of the backboard and extending upward beyond an upper edge thereof, and a plurality of integrally formed trajectory indicators permanently incorporated into the front impact surface of the backboard, the trajectory indicators comprising:

a downward first trajectory indicator extending downwardly from a central region of the backboard, a substantially horizontal level trajectory indicator extending laterally across the backboard; and, an upward second trajectory indicator extending upwardly toward a hoop attached to the backboard; and, wherein each trajectory indicator comprises a raised, recessed, or molded contour that physically alters the surface geometry of the backboard to deflect light or provide tactile guidance to a player, thereby forming a structural and functional relationship with the backboard independent of printed matter;

wherein the trajectory indicators further include a first directional element and a second directional element each having an arrow-shaped profile formed as a contiguous molded feature of the trajectory indicators, such that the arrows visually and physically delineate intended ball-flight trajectories for short-range, mid-range, and long-range shots; and, wherein an intersection of the vertical alignment element and the level trajectory indicator defines a geometric reference point aligned with an expected ball-impact location during an optimal shot attempt, enabling consistent shot visualization independent of removable appliques or surface graphics.

2. The basketball backboard shot assistance apparatus of claim 1, wherein the trajectory indicators are composed of a translucent or light-transmissive polymer layer embedded within the backboard and illuminated by at least one internal light source positioned behind the front impact surface to provide dynamic visual feedback corresponding to different shot distances and angles.

* * * * *